US005127247A

United States Patent [19]

Baisch

[11] Patent Number: 5,127,247

[45] Date of Patent: Jul. 7, 1992

[54] SPRING COILING MACHINE HAVING INTERCHANGEABLE PRESETTABLE ELEMENTS

[76] Inventor: Gerhard Baisch, Kälberauchtertstr. 4, D-7410 Reutlingen 2 (Gönningen, Fed. Rep. of Germany

[21] Appl. No.: 700,875

[22] Filed: May 10, 1991

Related U.S. Application Data

[63] Continuation of Ser. No. 381,418, filed as PCT/EP88/00010, Jan. 9, 1988, abandoned.

[30] Foreign Application Priority Data

Jan. 16, 1987 [DE] Fed. Rep. of Germany ..... 3701088

[51] Int. Cl.[5] ..... B21F 3/02

[52] U.S. Cl. ..... 72/140; 72/138

[58] Field of Search ..... 72/129, 130, 131, 135, 72/138, 140, 142

[56] References Cited

U.S. PATENT DOCUMENTS

| | | | |
|---|---|---|---|
| 2,614,696 | 10/1952 | Kirchner . | |
| 2,655,973 | 10/1953 | Hoelsch . | |
| 2,902,079 | 9/1959 | Costello et al. | 72/131 |
| 3,613,420 | 10/1971 | Perrenoud | 72/131 |
| 3,740,984 | 6/1973 | Bergevin | 72/131 X |
| 3,934,445 | 1/1976 | Lampietti | 72/129 |
| 4,173,135 | 11/1979 | Lamperti | 72/138 X |
| 4,587,821 | 5/1986 | Sykes | 72/138 X |

FOREIGN PATENT DOCUMENTS

| | | |
|---|---|---|
| 604746 | 10/1934 | Fed. Rep. of Germany . |
| 892133 | 10/1953 | Fed. Rep. of Germany . |
| 1003682 | 3/1957 | Fed. Rep. of Germany . |
| 664806 | 10/1963 | Fed. Rep. of Germany . |
| 1242434 | 6/1967 | Fed. Rep. of Germany . |
| 381633 | 10/1964 | Switzerland . |
| 415236 | 1/1967 | Switzerland . |

OTHER PUBLICATIONS

"Voreinstellen der Werkzeuge Ausserhalb der Maschine mit Geeigneten Messgerate", Kurt Hauser, *Maschinenmarkt*, Wurzburg 90 (1984) 20, pp. 424–427.

"Moglichkeiten und Methoden der Werkzeugvoreinstellung", H. Schulz, *Werkstatt und Betriess*, 97. Jahrg, 1064, Heft 4, pp. 287–292.

"Wafios Automatic Universal Spring Coiling Machines", *Druckschrift* 210/1.

*Primary Examiner*—Lowell A. Larson
*Assistant Examiner*—Michael J. McKean
*Attorney, Agent, or Firm*—Wigman & Cohen

[57] ABSTRACT

A coiling device for spring coiling machines, having exchangeable elements that contain adjusting screws. Each coiling pin is mounted in a receptacle so as to rotate therewith and so as to be able to rotate therein about its longitudinal axis after a clamping screw is loosened, and to be capable of moving in its longitudinal direction by means of a set screw, and whereby each coiling pin receptacle is mounted in or on a coiling pin holder, by means of which the coiling pin held in the receptacle can be pivoted in a controlled manner by means of set screws, and can be changed in position by means of an adjusting slide that mounts the coiling pin holder, by means of at least one set screw. One or two such coiling devices are preset in one finger or two finger spring coiling machines to produce helical springs from endless wire. An adjusting device is also provided for coiling tools on spring coiling machines having a coiling device.

22 Claims, 3 Drawing Sheets

SPRING COILING MACHINE HAVING INTERCHANGEABLE PRESETTABLE ELEMENTS

This is a continuation of co-pending application Ser. No. 07/381,418 filed as PCT/EP88/00010, Jan. 9, 1988 now abandoned.

BACKGROUND OF THE INVENTION

One object of the invention is, in accordance with the preamble of claim 1, a coiling device for spring coiling machines, having exchangeable elements that contain adjusting screws, whereby each coiling pin is mounted in a receptacle so as to rotate therewith and so as to be able to rotate therein about its longitudinal axis after a clamping screw is loosened, and to be capable of moving in its longitudinal direction by means of a set screw, and whereby each coiling pin receptacle is mounted in or on a coiling pin holder, by means of which the coiling pin held in the receptacle can be pivoted in a controlled manner by means of set screws, and can be changed in position by means of an adjusting slide that mounts the coiling pin holder, by means of at least one set screw. One or two such coiling devices are preset in one finger or two finger spring coiling machines to produce helical springs from endless wire.

Another object of the invention is, in accordance with the preamble of claim 10, an adjusting device for coiling tools on spring coiling machines having a coiling device, for example of the above-described type, having an adjustable tool receptacle in which a coiling tool is mounted so as to be adjustable by means of a set screw in the direction of its longitudinal axis that crosses the longitudinal axis of the spring to be produced; having a tool holder that carries the tool receptacle, which is mounted thereon so as to be capable of being rotated by means of a pair of set screws supported on both sides of the tool on the tool holder; and having an adjustment slide that can be mounted laterally to the spring axis on which the tool holder is arranged so as to be capable of being pivoted about its longitudinal axis lying parallel to the spring axis by means of a bolt; whereby the tool holder is supported by means of a set screw on one side of its pivot axis on a device element that cannot slide.

With the aid of a suitable quick-clamp coiling pin holder and an adjusting device adapted therefor, the primary adjusting procedures should be able to be performed outside of the machine. This achieves an improved degree of utilization of the production machine, the reproducibility of a setting once attained, and machine servicing by less qualified personnel.

This is not possible with the presently known coiling systems, because for the most part they operate with holders that are permanently installed in the machine, and in which round coiling pins are inserted into a bore. By rotating about their own axes, these coiling pins can be brought into the necessary operating position and clamped in place. No type of adjusting aids are provided for this purpose, although it is precisely the locating of the correct angular position that has the greatest significance in the overall setting, and this requires well trained personnel.

Subsequent fine adjustments are almost a matter of luck in this system, because the clamp must first be released for any such attempt without the previous position being retained and therefore relocatable. A reproducibility of earlier settings is for this reason not possible, although particularly with spring coiling machines this should be extremely important for reasons of the degree of utilization, because spring production cannot begin until several test springs have completed all subsequent operational processes such as start-up, setting, grinding, deburring and force testing. This often means hours of waiting time for a machine intended for production. For extremely small or extremely large spring diameters, the coiling pins, the axes of which are normally parallel to the adjusting device of the slider supporting them, must be able to pivot. There are corresponding points of rotation in the known systems, but only for an uncontrolled adjustment.

The object of the invention, then, is to realize exchangeable coiling pin holders that can be preset outside of the machine in which the coiling pins can move in a controlled manner in rotation about their axes, and in moving in the direction of their longitudinal axes, as well as perpendicularly thereto. In addition, it must be possible to pivot the longitudinal axes of the coiling pins, which normally run parallel to the adjustment direction of the adjustment slide carrying the coiling pin holders, in the negative or positive angular range.

An adjustment device must make it possible to undertake the above-referenced four adjustments outside of the machine on the basis of the values obtained from the coil ratio and the wire thickness of the springs to be produced, whereby no unintentional changes may arise through the installation in the machine.

Because spring steel wire can fluctuate in its hardness and therefor in its coiling behavior, a controlled subsequent adjustment must be possible in the machine.

SUMMARY OF THE INVENTION

This object is achieved according to the invention in a coiling device of the type mentioned in the preamble of claim 1 in a distinctive manner in that each coiling pin receptacle can be rotated in a controlled manner about the longitudinal axis of the mounted coiling pin by means of the set screws that cooperate with the coiling pin holder; that a pivot axis of each coiling pin holder perpendicularly crosses the longitudinal axis of the held coiling pin; and in that the position of each coiling pin relative to its adjusting slide can be set by moving the coiling pin receptacle by means of a set screw; whereby each coiling pin receptacle and the set screws for rotating the inserted coiling pin about its longitudinal axis form an exchangeable, presettable element, and each coiling pin holder and the set screws for rotating the held coiling pin about the pivot axis that is perpendicular thereto also form an exchangeable, presettable element.

U.S. Pat. No. 3,934,445 discloses a coiling device according to the preamble of claim 1. In this device the coiling pin receptacle can be rotated about a tipping axle in a controlled manner by means of set screws that cooperate with the coiling pin holder and are mounted on such holder, said tipping axle being mounted on the coiling pin holder and crossing the longitudinal axis of the received coiling pin perpendicularly at a skewed angle. This possibility of rotation is not absolutely necessary, however. The pivot axis of the coiling pin holder intersects the longitudinal axis of the mounted coiling pin perpendicularly. The setting of the position of the coiling pin relative to its adjusting slide by moving the coiling pin receptacle by means of a set screw is only possible if the longitudinal axis of the coiling pin is tipped simultaneously. The coiling pin receptacle and the set screws for tipping the received coiling pin on the one hand, and the coiling pin holder for pivoting the received coiling pin about the pivot axis perpendicularly thereto on the other hand, do not form, either individually or together, at least one exchangeable, presettable element.

The object of the invention is achieved in an adjusting device of this type mentioned in the preamble of claim 10 in the distinctive manner that the tool receptacle can be rotated about the longitudinal axis of the tool by means of the pair of set screws; that the longitudinal axes of the bolt or tool attached to the-adjusting slide always intersect each other at a right angle; that a set screw is mounted on the tool holder parallel to the longitudinal axis of the bolt and is supported against the adjusting slide; and that a second pair of set screws is provided that are supported on the portion of the device that does not slide, on both sides of the pivot axle of the tool holder; whereby the tool receptacle with a tool in place, the set screw for the longitudinal adjustment thereof, and the first pair of set screws form a first structural unit that can be easily separated from the tool holder in the longitudinal direction of the tool, and the tool holder, the set screw for adjustment of the tool holder parallel to the spring axis and the second pair of set screws form a second structural unit that can be separated from the adjusting slide in the longitudinal direction of the bolt after a latch is released, which, like the first unit, can be preset in a separate adjustment device by adjusting its adjusting screws, and in addition, can be joined with the first unit on one side and with the adjusting slide on the other side, each axially.

DE-C-892,133 discloses an adjustment device according to the preamble of claim 10. In this device, as in the case of U.S. Pat. No. 3,934,445, the tool receptacle can be rotated by means of a pair of set screws about a tipping axis that crosses the longitudinal axis of the tool perpendicularly at a skewed angle. Consequently, the spring diameter, and possibly the prebiasing with which the coiling tool contacts the spring, are necessarily changed by the tipping of the tool receptacle. The longitudinal axes of the pivot bolt attached to the tool holder, i.e., the tool shifting, cross each other perpendicularly, and at a skewed angle, more than they really intersect. There is no set screw mounted parallel to the longitudinal axis of the bolt on the tool holder and supported against the adjusting slide. But, by means of the two set screws for tipping the tool receptacle, however, it is not possible to adjust the height position of the coiling tool relative to the adjusting slide by sliding the coiling pin holder along the pivot axis by means of a set screw. Also absent is a second pair of set screws supported on both sides of the pivot axis of the tool holder on a portion of the device that does not slide. All that is present is a single set screw and a stop on the slide which cannot touch each other because the set screw is quasi tensilely loaded, for the tool arranged approximately diametrically opposite relative to the pivot axis pivots the set screw away from the non-sliding stop during the prescribed rotational direction of the spring and the friction present between them. Finally, here, too, the tool receptacle with the received tool, the set screw for longitudinal displacement thereof and the first single pair of set screws does not form a first structural unit that is easily separable from the tool holder in the longitudinal direction of the tool, nor does the tool holder, a set screw for the adjustment of the tool holder parallel to the spring axis and a second pair of set screws form a second structural unit that is separable from the adjusting slide in the longitudinal direction of the bolt after the release of a latch, for example by removing a screw head, which, like the first unit can be preset in a separate adjusting device by adjusting its adjusting screws and which can be joined with the first unit on the one hand and joined on the other side to the adjusting slide, each axially.

In the preferred embodiments of the coiling device according to the invention according to claim 1, it is provided in accordance with claims 2 and 3 that the set screws of each unit for rotating and pivoting a coiling pin are supported against a surface connected rigidly with the associated coiling pin holder or adjusting slide on different sides of the rotational axis (longitudinal axis of the coiling pin) or pivot axis.

The coiling pin receptacle that can be rotated in a controlled manner is achieved in that set screws are arranged on both sides of the rotational axis and rest against a reference surface. This reference surface is part of the coiling pin holder that supports the coiling pin receptacle. By tightening one set screw and loosening the other, a rotation of the coiling pin is effected. By tightening both set screws the required operational position of the coiling pins is fixed.

If the coiling pin receptacle is to be removed from the coiling in holder, one need only open a single set screw. After the coiling pin receptacle is replaced, one need only retighten this same screw in order to precisely return to the last position. The reproducibility of a setting once obtained is thus provided.

The controlled pivoting movement of the coiling pin holder is achieved according to the same principle. The reference surface for this purpose can be integrated directly into the mounting bolts of the pivot axis or be located at a different location on the adjusting slide as an additional surface. All that is important thereby is the fact that the set screws are positioned on both sides relative to the pivot axis.

As indicated, an additional object of the invention is an adjusting device to preset the set screws of the preferred embodiments of the coiling device according to the invention. This adjusting device is distinguished in accordance with the invention in claims 7 and 8 by a support surface for the reference surface that corresponds to the rotation set screws and may be capable of rotation about a metering axle corresponding to the rotational axis (longitudinal axis of the coiling pin), to set the rotation set screws during the mounting, if necessary nonrotationally, of the coiling pin receptacle supporting them; and by a transfer of the rotation of the reference surface to an angle metering device, i.e., by means of a reference surface which corresponds to the support surface for the pivot set screws and with a reference surface that can rotate about a metering axle corresponding to one of the pivot axes for setting the pivot set screws in the nonrotational mounting of the coiling pin holder containing them; and by a transfer of the rotation of the metering axle to an angle metering device.

According to claim 11, an adjusting device according to the invention for the first and second structural units with set screws of the adjusting device according to claim 10 is distinguished by a base plate with bolts corresponding to the adjusting slide with bolts and the nonsliding portion, i.e., a mounting element that can rotate about its vertical axis having a reference surface to support the second pair of set screws of the tool holder nonrotationally mounted on the base plate on both sides of the rotational axis of the mounting element; by a support surface secured to a plate for the first pair of set screws of the tool receptacle with a tool contained therein which tool itself or by means of an attachment has a cross-sectional profile that deviates from the circular and can be inserted into a corresponding nonround hole in the bolt secured to the plate; and by an angle meter coupled with the rotatable mounting element to measure increments of a mounting element rotation. If this adjusting device according to CH-A-415,236 is provided with an axle standing perpendicularly on the base plate, on which there is mounted an extension arm arranged parallel to the plate and having a length meter (metering clock) is mounted so as to be movable axially, it is preferred according to claim 12 that the extension arm can be pivoted about the axle until the length meter is located above a tool holder arranged nonrotationally on the bolt secured to the plate; and that the base plate contains a sleeve for mounting a tool receptacle with a received tool in a vertical position in the pivot range of the extension arm. In the adjusting device "for a rotary bank" disclosed in CH-A-415,236, an "apparatus for setting the tools in a tool holder in advance", the tool holder is attached to the head of a spindle that is mounted in a bushing attached to the base plate so that the tool holder is rotatably arranged relative to the bushing secured to the plate. The base plate contains another bushing for the rotary mounting of a spindle in a vertical position, which receives a stop cylinder that cooperates with the tool holder, the stops of which can also be set in advance by means of the device and can be attained in sequence by a second length meter on a second extension arm, which, like the first extension arm, can be pivoted about the axle standing perpendicularly on the base plate.

By providing for presettings in the adjusting device outside of the machine, the possibility of precisely reproducing a once-achieved adjustment setting, is also utilized. For this purpose the coiling pin located in the coiling pin receptacle is inserted into an adapted hole arranged in the metering axle. Through appropriately setting both screws against a reference surface, the required rotation is effected, and can be read from a metering device. Once the correct adjustment value is attained, a screw is opened, the coiling in receptacle is removed, inserted into the coiling pin holder and fixed in the required operating position by tightening the same screw.

The presetting of the coiling pin holders in the adjusting device proceeds in accordance with the same concept. The reference surface for the set screws, however, here is not secure, but rather displays a portion of the rotatable pivot axle, its angular movement and thereby the setting value. The positioning of the coiling pin holder in the direction of the pivot axis is achieved with a spacer screw, by means of which the spacing from the setting-sliding plane can be set according to the wire thickness coming in for processing and the desired prebiasing.

The adjustment also takes place in the adjustment device by means of a suitable length measuring device. This device is also used for the length setting of the coiling pins, whereby the coiling pin receptacles are held in a sleeve that can be adjusted in the longitudinal direction.

The connection of the coiling pin holder to the adjustment sliders takes place after the preliminary setting and positioning on the pivot axle have been completed by screws, whereby the spacing screw serves as an end stop. If a single screw is adequate to provide sufficient strength, a threaded bore therefor is advantageously provided in the pivot axle.

In smaller and average sized spring coiling machines, the coiling pins can be round, four-sided and rectangular, provided that the coiling pin receptacle is shaped to correspond. In larger spring coiling machines, on which thick wires are processed, the coiling pin receptacles are advantageously formed so that inserts that are similar to turntables can be screwed into place.

In small spring coiling machines that must process the finest wires, spacial relationships are naturally very limited. One possibility in this situation is not to use the coiling pin receptacle and to store round coiling pins directly in the coiling pin holder. In order to provide here, too, that a controlled adjusting and setting is possible, a collar containing the two necessary set screws is moved over it and fixed in place.

Of great significance and as an important requirement for the practical use of this experience is the fact that with the solutions described above, a subsequent adjustment of all devices within the machine is possible.

In this manner it is assured that the described winding device can be set in accordance with its stated object, and that the desired requirements such as an improved degree of machine utilization, simpler and more rapid machine set up and more reliable reproducibility are achieved. An additional effect also results when several coiling pin holders are used, each having corresponding tools. During the further handling of test springs, the coiling pin holders used in their manufacture can be removed while retaining the correct setting until it is released. During this period the machine can produce other springs with different coiling pin holders.

The measuring mechanism of the adjusting device can operate mechanically or electronically. In the former case the rotational movement of the measuring axle is transferred to an analog angle measurer by means of a lever linkage, while the longitudinal adjustment is performed by solid stops or by means of a metering clock. In an electronic embodiment, an angle increment indicator would be located on the measuring axle, the impulses of which would be made visible on a display of an indicating device.

BRIEF DESCRIPTION OF THE DRAWINGS

The invention will now be described in greater detail with the aid of exemplary embodiments illustrated in the drawings. Shown are.

DETAILED DESCRIPTION OF THE INVENTION

Figures 1A, 1B:
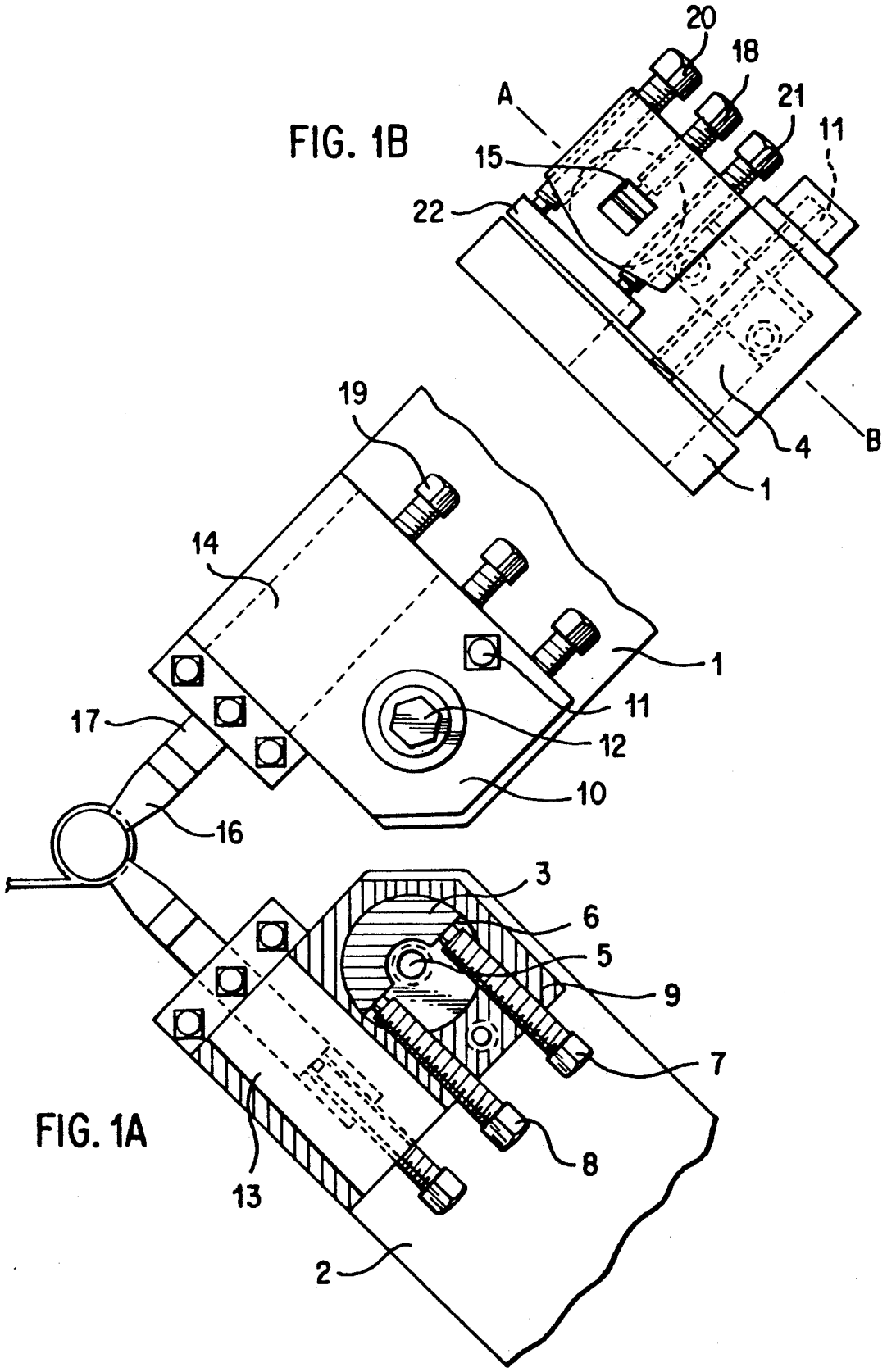
FIGS. 1A and 1B show an embodiment of a two-finger coiling system with a reference surface that is integrated into the pivot axle, whereby a coiling pin holder is illustrated in section AB.

In the two finger coiling system, two adjustment slides 1/2 are provided, being arranged at 90 degrees to each other. A bolt 3/4 is securely anchored to each, arranged perpendicularly to the slide plane. At the center of each such bolt is a threaded hole 5, and perpendicular to the direction of movement is a reference surface 6 as a support for the set screws 7/8 that serve to control the pivoting motion and are located in the coiling pin holders 9/10 that are formed as mirror-images of each other.

The spacing from the slide plane is changed with the stop screws 11 and the solid connection between the adjusting slide 1/2 and the coiling pin holder 9/10 is achieved with the screws 12.

The coiling pin receptacles 13/14 are provided with a four-sided hole 15. A piece that is rectangular in cross-section with an insert 17 is used as the coiling pin 16. The screw 18 is used for clamping in position and the screw 19 performs the longitudinal adjustment. The screws 20/21, which are supported against the surface 22, serve to control the rotation.

Figure 2A:
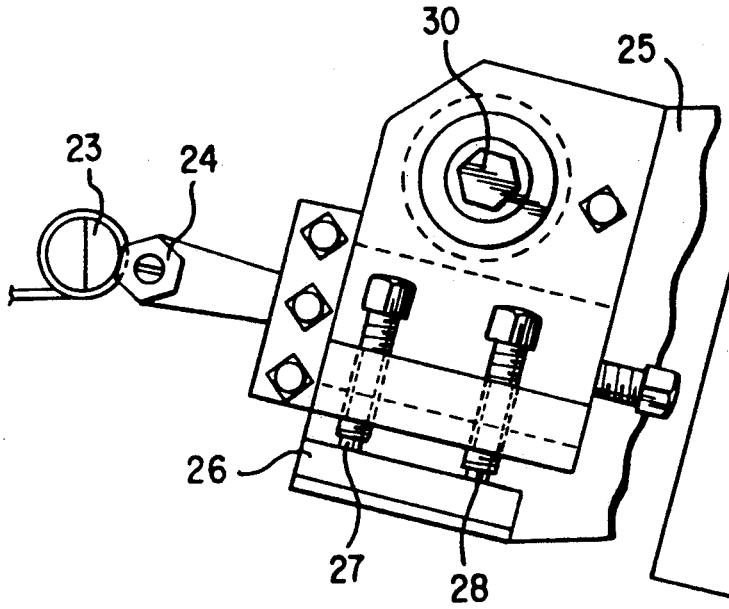
FIGS. 2A and 2B show an embodiment of a one finger coiling system with an external reference surface and a coiling tool that is similar to a turntable.
Figure 2B:
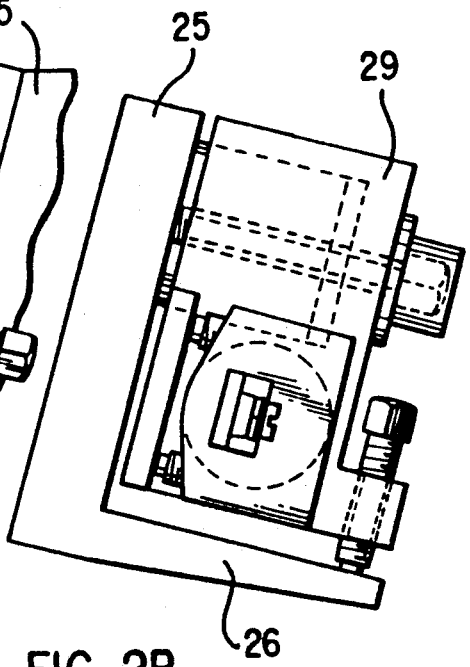
Figure 3A:
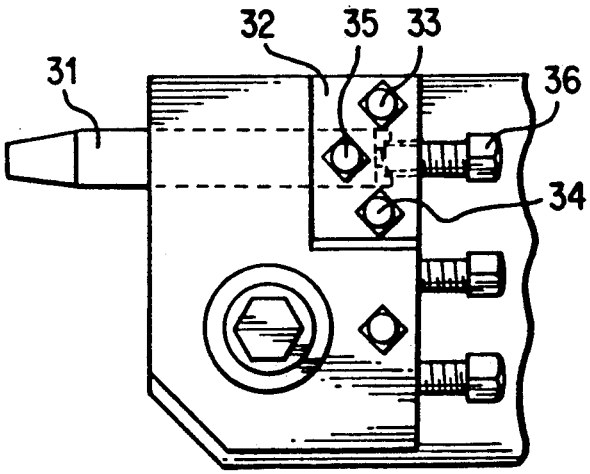
FIGS. 3A and 3B show an embodiment with a directly mounted round coiling pin having an adjustment collar that is pushed up over it.
Figure 3B:
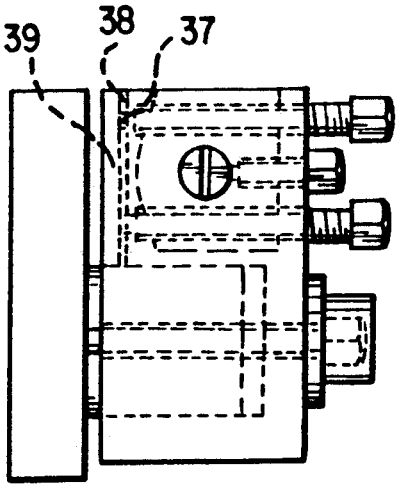
Figure 4A:
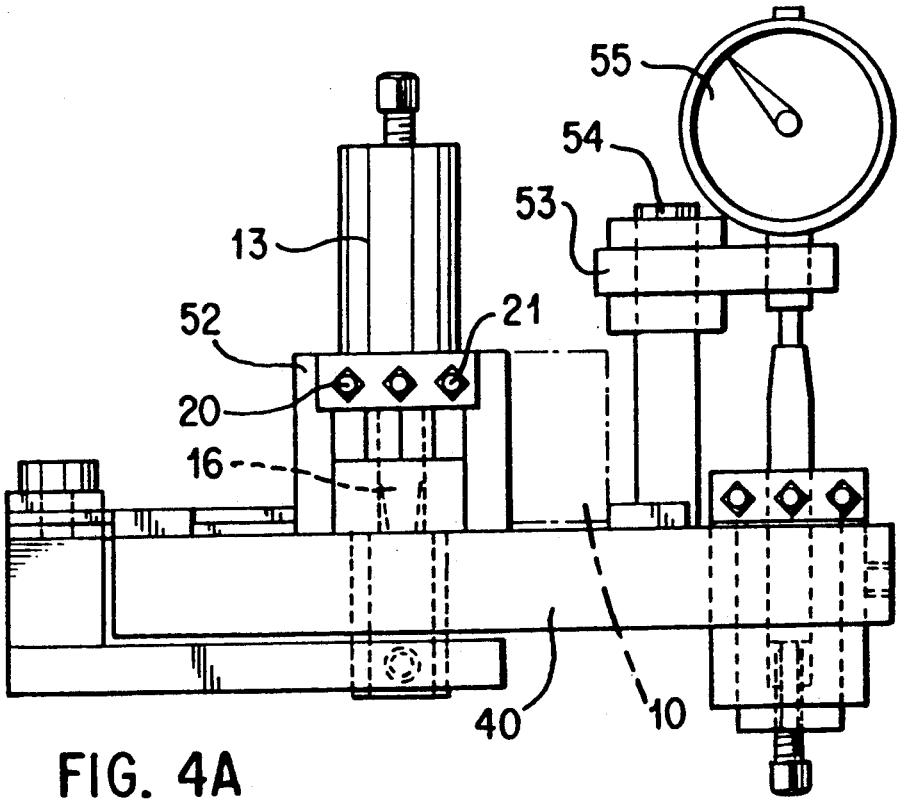
FIGS. 4A and 4B show an embodiment of an adjusting device for presetting having a mechanical display, whereby in the side view the rotation of a coiling pin receptacle and the longitudinal adjustment of the coiling pins are illustrated, while in the top view the adjustment of a coiling pin holder can be recognized.
Figure 4B:
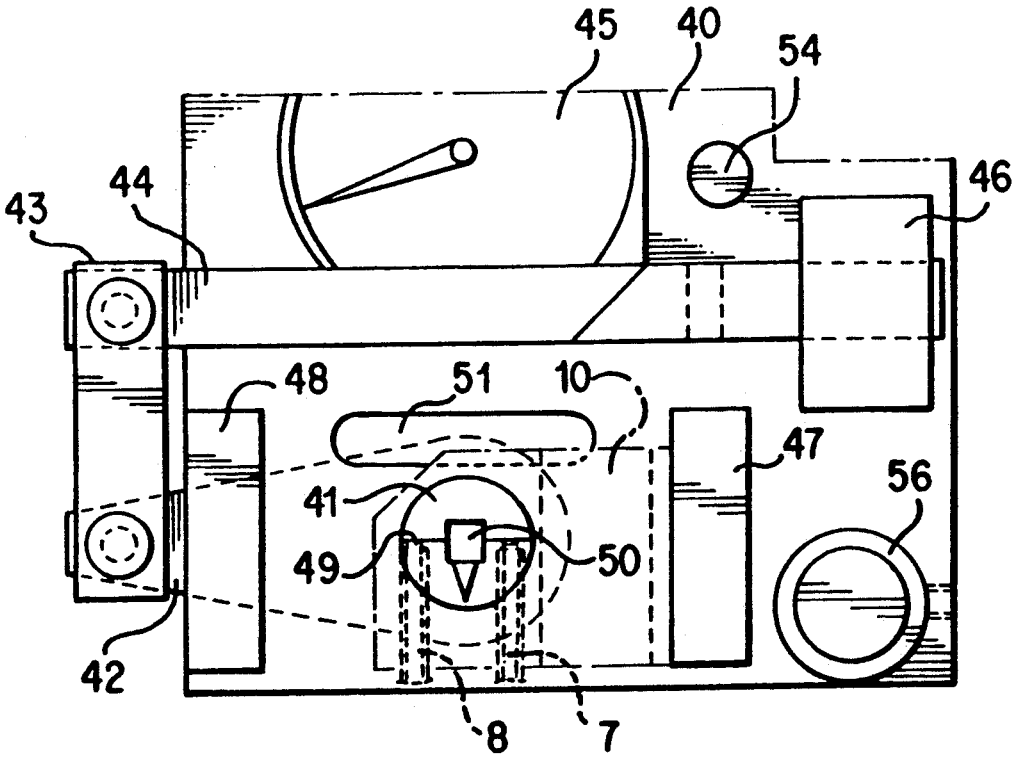

In the one finger coiling system the cutting mandrel 23 is used as a diversion guide. FIGS. 2A and 2B illustrate an embodiment in which a coiling tool that is similar to a turntable provided with a six-sided hard metal element 24 is used.

The adjustment slide 25 is provided with an external reference surface 26 for the controlled pivoting movement, which is effected with the screws 27/28. The coiling pin holder 29 is formed in such a manner that these screws engage on both sides of the pivot axle 30.

In the direct mounting of a round coiling pin 31, the collar 32 is brought to the end. It contains the two screws 33/34 necessary to control rotation, a clamping screw 35 and a screw 36 for longitudinal adjustment. With the small forces that occur here it is sufficient if the feet 37 of the four-sided screws 33/34 are supported in a groove 38 in the reference surface 39.

The adjusting device for presetting consists of a base plate 40, in which a bolt 41, which serves as a metering axle, is rotatably mounted. The rotational movement of this bolt is transferred via a lever linkage 42/43/44 to an analog, mechanical angle measuring device 45, which is connected with the strap 46 on the base plate so as to resist torsion. In an adjustment, the coiling pin holder 10 is pushed from above over the bolt 41, namely in such a manner that its edge farthest removed from the metering axle abuts the shoulder 47, while the mirror-image coiling pin holder 9 is allowed to abut the opposite shoulder 48. This assures a positioning that is secured against rotation.

At its upper end, the bolt 41 is formed in such a manner that a reference surface 49 is present for the screws 7/8 provided to control the pivot movement. Through appropriate adjustment of these screws, the bolt 41 is rotated either clockwise or counterclockwise, which can be read on the angle meter 45.

A four-sided hole 50, which serves to receive the coiling pin 16 located in the coiling pin receptacles, is located in the metering axle of the bolt 41. A plate 52 that can be inserted in the slot 51 in the base plate provides the reference surface for the screws 20/21 that serve to control the rotation and effect the presetting. The adjusting device has an extension arm 53 on which is arranged a metering clock 55 that can pivot about the axle 54 into the metering position, to permit height adjustment of the coiling pin holder 9/10 with the spacing screw 11 and to permit longitudinal adjustment of the coiling pin 16 with the set screw 19.

The height adjustment of the coiling pin holder 9/10 takes place with the aid of the metering clock 55 in the same position as in the controlled adjustment of the pivot movement. The coiling pin receptacles 13/14 are inserted for this purpose into a special sleeve 56 that can be adjusted in the longitudinal direction.

I claim:

1. A coiling device for spring coiling machines, comprising exchangeable, presettable elements, each element having a plurality of set screws disposed therein, and further comprising a coiling pin nonrotationally mounted in a coiling pin receptacle by means of a first set screw, said pin movable in a pin longitudinal axis direction by means of the first set screw, said coiling pin receptacle mounted in or on a coiling pin holder, said coiling pin held in the receptacle pivotable about the pin longitudinal axis in a controlled manner by means of second set screws and said coiling pin adjustable in position by means of an adjusting slide that mounts the coiling pin holder positionable by means of third set screws, said coiling pin receptacle is rotatable in a controlled manner about the longitudinal axis of the mounted coiling pin by means of said second set screws that cooperate with the coiling pin holder; a pivot axis of said coiling pin holder aligned to perpendicularly cross the longitudinal axis of the mounted coiling pin; and the position of the coiling pin relative to the adjusting slide associated therewith is adjustable by displacing and rotating the coiling pin receptacle by means of a fourth set screw and said third set screws, respectively; said coiling pin receptacle and said second set screws for rotating the mounted coiling pin about its longitudinal axis cooperate to form a first exchangeable, presettable element, and each coiling pin holder and said third set screws for pivoting the mounted coiling pin about the pivot axis perpendicular thereto cooperate to form a second exchangeable, presettable element.

2. Coiling device according to claim 1, wherein the second set screws for rotating a coiling pin are supported against a first support surface rigidly connected with the associated coiling pin holder on different sides of the longitudinal axis of the coiling pin.

3. Coiling device according to claim 2, further including a bore in the coiling pin holder for mounting of the receptacle of a round coiling pin on the associated coiling pin holder.

4. Adjusting device for presetting set screws in the coiling device according to claim 2, further comprising a first reference surface that corresponds to the first support surface for the rotational second set screws and rotatable about a metering axis corresponding to the longitudinal axis of the coiling pin, for positioning the rotational second set screws in a nonrotatable coiling pin receptacle; and further characterized by transferability of the rotation of the reference surface to an angle metering device.

5. Adjusting device, according to claim 4, on a coiling device having second set screws for pivoting a coiling pin which are supported against a second surface rigidly connected with the associated adjusting slide on different sides of the pivot axis, the adjusting device adapted for presetting the second set screws including a second reference surface that corresponds to the second support surface for the pivoting second set screws and can rotate about a metering axis corresponding to the longitudinal axis for positioning the pivoting second set screws, said coiling pin holder holding said second set screws is nonrotatably mounted; and further characterized by transferability of the rotation of the metering axis to an angle metering device.

6. Adjusting device according to claim 5, wherein the first reference surface for positioning the rotational second set screws is nonrotatable, and the coiling pin receptacle is nonrotationally connected with the metering axis by means of the coiling pin.

7. Coiling device according to claim 1, wherein the second set screws for pivoting a coiling pin are supported against a second support surface rigidly connected with the associated adjusting slide on different sides of the pin longitudinal axis.

8. A coiling device according to claim 7, wherein the coiling pin receptacle is provided with a central hole having a quadratic cross-sectional shape adapted to receive a coiling pin selected from the group of shapes consisting of round or four-sided shapes and further adapted to receive an attachment.

9. A coiling device according to claim 7, wherein the coiling pin receptacle is adapted to receive a coiling tool generally in the shape of a turntable.

10. A coiling device according to claim 7, further including a bore in the coiling pin holder for mounting the receptacle of a round coiling pin on the associated coiling pin holder.

11. Coiling device according to claim 1, wherein the coiling pin receptacle is provided with a central hole having a quadratic cross-sectional shape adapted to receive a coiling pin selected from the group of shapes consisting of round or four-sided shapes and further adapted to receive an attachment.

12. A coiling device according to claim 11, further including a bore in the coiling pin holder for mounting the receptacle of a round coiling pin on the associated coiling pin holder.

13. Coiling device according to claim 1, wherein the coiling pin receptacle is adapted to receive a coiling tool generally in the shape of a turntable.

14. A coiling device according to claim 13, further including a bore in the coiling pin holder for mounting the receptacle of a round coiling pin on the associated coiling pin holder.

15. Adjusting device for coiling tools on machines for coiling springs having a longitudinal axis, having an adjustable tool receptacle in which a coiling tool is mounted so as to be adjustable by means of a first set screw in the direction of a coiling tool longitudinal axis that crosses the longitudinal axis of the spring to be manufactured; having a tool holder that supports the tool receptacle, which tool receptacle is rotatably mounted on said tool holder by means of a pair of second set screws that are supported on the tool holder on both sides of the tool; and having an adjusting slide mounted laterally to the spring longitudinal axis, on which slide the tool holder is pivotable about a tool holder longitudinal axis lying parallel to the spring longitudinal axis; the tool holder supported on both sides of the tool holder longitudinal axis on a slide portion of the device comprising a bolt having two reference surfaces by means of third set screws; characterized in that the tool receptacle is rotatable about the longitudinal axis of the coiling tool by means of the pair of second set screws; that the longitudinal axes of the bolt attached to the adjusting slide and the tool, respectively intersect each other perpendicularly; that a fourth set screw is mounted parallel to the longitudinal axis of the bolt on the tool holder and is supported on the adjusting slide; and that the pair of second set screws is mounted on both sides of the longitudinal axis of the tool on the tool receptacle; the tool receptacle with mounted tool, the first set screw for the longitudinal adjustment thereof and the pair of second set screws cooperate to comprise a first structural unit that is easily separable from the tool holder in the direction of the longitudinal axis of the tool, and the tool holder, the fourth set screw for the adjustment of the tool holder parallel to the spring longitudinal axis and the pair of third set screws cooperate to comprise a second structural unit that can be separated from the adjusting slide in the direction of the longitudinal axis of the bolt after a latch is released which second structural unit, like the first structural unit, is presettable in a separate adjusting device by adjusting the set screws associated therewith and is axially joinable with the first structural unit and with the adjusting slide.

16. An adjusting device for coiling tools on a spring coiling machine, each spring having a spring longitudinal axis, said adjusting device comprising:

(a) a first structural unit comprised of
  (i) an adjustable tool receptacle;
  (ii) a coiling tool mounted in said tool receptacle, said coiling tool having a coiling tool longitudinal axis and at least two sides;
  (iii) a first set screw for adjusting said coiling tool along said coiling tool longitudinal axis;
  (iv) a pair of second set screws for rotating said tool receptacle about said coiling tool longitudinal axis, (b) a second structural unit comprised of
  (i) a tool holder for supporting said tool receptacle, said tool holder having a tool holder pivoting axis, a slide portion including two reference surfaces on a bolt, said bolt having a longitudinal axis, said receptacle mounted on said tool holder by said second set screws, said second set screws supported on said holder on said two sides of said tool,
  (ii) a pair of third set screws, supported on both sides of the tool holder pivoting axis on said reference surfaces,
  (iii) a fourth set screw for adjustment of the tool holder longitudinal axis parallel to the spring longitudinal axis, said fourth set screw mounted parallel to the bolt longitudinal axis and supported on an adjusting slide, (c) the adjusting slide mounted laterally to the spring longitudinal axis, said tool holder mounted on said slide and pivotable about the tool holder pivoting axis lying parallel to said spring longitudinal axis, (d) a releasable latch for holding said second structural unit to said adjusting slide, wherein said longitudinal axes of said bolt attached to said adjusting slide and said tool, respectively intersect perpendicularly, said first structural unit is easily separable from said tool holder along said tool longitudinal axis, said second structural unit is easily separable from said adjusting slide along the bolt longitudinal axis upon the release of said latch, said first structural unit is axialy joinable with said second structural unit which is axially joinable with said adjusting slide, and said first and second structural units each presettable, in an adjusting device external therewith, by adjusting said set screws.

17. Adjusting device for the first and second structural units having set screws in the adjusting device according to claim 14; having a base plate with a bolt corresponding to the adjusting slide with a bolt and the nonmovable portion, having a mounting element that can rotate about a mounting element vertical axis, with a reference surface for supporting the pair of second set screws of the tool holder that is nonrotationally mounted on the base plate on both sides of the vertical rotational axis of the mounting element; having a support surface secure to a plate for the pair of second set screws of the tool receptacle with a mounted tool, which itself or by means of an attachment has a cross-sectional profile that deviates from the circular and can be inserted in a corresponding non-circular hole in the bolt secured to a plate; and having an angle meter coupled with the rotational mounting element, which angle meter measures increments of a mounting element revolution.

18. Adjusting device according to claim 17, having an axle that stands perpendicularly on the base plate, and on which an extension arm including a length measuring device and arranged parallel to the plate, is mounted in such a manner as to be axially displaceable, the extension arm can be pivoted about the axle until the length measuring device stands above a tool holder that is nonrotationally arranged on the bolt secured to the plate; and that the base plate, in the rotational range of the extension arm, contains a sleeve for the mounting of a tool receptacle with the mounted tool in a vertical position.

19. A coiling device for spring coiling machines comprising exchangeable presettable elements including:

(a) a coiling pin;

(b) a coiling pin receptacle mounted on a coiling pin holder, (c) a first set screw for mounting said coiling pin in said coiling pin receptacle and for adjusting pin position along a pin longitudinal axis, (d) second set screws for holding said coiling pin receptacle and for permitting pivoting of said receptacle about said pin longitudinal axis, (e) an adjusting slide that mounts said pin holder for adjusting said coiling pin position, and (f) third set screws cooperating with said adjusting slide for permitting rotation of said receptacle about an axis perpendicular to the pin longitudinal axis, said coiling pin receptacle, and said second set screws forming a first exchangeable presettable element, said coiling pin holder, and said third set screws forming a second exchangeable presettable element.

20. A coiling device for spring coiling machines, comprising exchangeable, presettable elements, each element having a plurality of set screws disposed therein, and further comprising a coiling pin nonrotationally mounted in a coiling pin receptacle by means of a first set screw, said pin movable in a pin longitudinal axis direction by means of the first set screw, said coiling pin receptacle mounted in or on a coiling pin holder, said coiling pin held in the receptacle pivotable about the pin longitudinal axis in a controlled manner by means of second set screws and said coiling pin adjustable in position by means of an adjusting slide that mounts the coiling pin holder positionable by means of third set screws, said coiling pin receptacle is rotatable in a controlled manner about the longitudinal axis of the mounted coiling pin by means of said second set screws that cooperate with the coiling pin receptacle; a pivot axis of said coiling pin holder aligned to perpendicularly intersect the longitudinal axis of the mounted coiling pin; and the position of the coiling pin relative to the adjusting slide associated therewith is adjustable by displacing and rotating the coiling pin holder by means of a fourth set screw and said third set screws, respectively; said coiling pin holder and said second set screws for rotating the mounted coiling pin about its longitudinal axis cooperate to form a first exchangeable, presettable element, and said adjusting slide and said third set screws for pivoting the mounted coiling pin about the pivot axis perpendicular thereto cooperate to form a second exchangeable, presettable element.

21. A coiling device for spring coiling machines comprising exchangeable presettable elements including:

(a) a coiling pin;

(b) a coiling pin receptacle mounted on a coiling pin holder, (c) a first set screw for mounting said coiling pin in said coiling pin receptacle and for adjusting pin position along a pin longitudinal axis, (d) second set screws for holding said coiling pin receptacle and for permitting pivoting of said receptacle about said pin longitudinal axis, (e) an adjusting slide that mounts said pin holder for adjusting said coiling pin position, and (f) third set screws cooperating with said holder for permitting rotation of said receptacle about an axis perpendicular to the pin longitudinal axis, said coiling pin holder and said second set screws forming a first exchangeable presettable element, said adjusting slide and said third set screws forming a second exchangeable presettable element.

22. A coiling device as in claim 1, 13, 20 or 21, further comprising a clamping screw for securing said coiling pin in said coiling pin receptacle and for permitting said coiling pin to move along said pin longitudinal axis and to rotate about said pin longitudinal axis.

* * * * *

UNITED STATES PATENT AND TRADEMARK OFFICE

CERTIFICATE OF CORRECTION

PATENT NO. : 5,127,247

DATED : July 7, 1992

INVENTOR(S) : Gerhard BAISCH

It is certified that error appears in the above-identified patent and that said Letters Patent is hereby corrected as shown below:

Claim 2, column 8, line 42, "claim 1" should be --claim 1, 13, 20 or 21--.

Claim 3, column 8, line 48, after "mounting" delete "of".

Claim 7, column 9, line 12, "claim 1" should be --claim 1, 13, 20 or 21--.

Claim 11, column 9, line 30, "claim 1" should be --claim 1, 13, 20 or 21--.

Claim 13, column 9, line 40, "claim 1" should be --claim 1, 13, 20 or 21--.

UNITED STATES PATENT AND TRADEMARK OFFICE

CERTIFICATE OF CORRECTION

PATENT NO. : 5,127,247

DATED : July 7, 1992

INVENTOR(S) : Gerhard BAISCH

It is certified that error appears in the above-identified patent and that said Letters Patent is hereby corrected as shown below:

Claim 17, column 11, line 13, "secure" should be --secured--.

Signed and Sealed this

Thirty-first Day of August, 1993

*Attest:*

*Attesting Officer*

BRUCE LEHMAN

*Commissioner of Patents and Trademarks*